United States Patent [19]

Kropp

[11] Patent Number: 4,635,440

[45] Date of Patent: Jan. 13, 1987

[54] DUAL CONSUMER HYDRAULIC MECHANISMS

[75] Inventor: Walter Kropp, Aschaffenburg, Fed. Rep. of Germany

[73] Assignee: Linde Aktiengesellschaft, Wiesbaden, Fed. Rep. of Germany

[21] Appl. No.: 617,111

[22] Filed: Jun. 4, 1984

[30] Foreign Application Priority Data

Jun. 14, 1983 [DE] Fed. Rep. of Germany ..... 3321484

[51] Int. Cl.[4] ..... F15B 13/02

[52] U.S. Cl. ..... 60/422; 60/431

[58] Field of Search ..... 60/422, 431; 41/516

[56] References Cited

U.S. PATENT DOCUMENTS

| | | | |
|---|---|---|---|
| 2,892,311 | 6/1959 | Van Gerpen | 60/422 |
| 3,994,133 | 11/1976 | Pfeil et al. | 60/422 |
| 4,023,646 | 5/1977 | Heisig et al. | 60/422 X |
| 4,034,563 | 7/1977 | Orth | 60/422 |
| 4,147,034 | 4/1979 | Johnson | 60/422 |
| 4,213,300 | 7/1980 | Biskis | 60/422 X |
| 4,343,151 | 8/1982 | Lorimor | 60/422 |

*Primary Examiner*—A. Michael Chambers

*Assistant Examiner*—John C. Fox

*Attorney, Agent, or Firm*—Buell, Ziesenheim, Beck & Alstadt

[57] ABSTRACT

A hydraulic arrangement with a pressure medium source and at least two consumers connected to it is provided in which the sum of the streams consumed by the consumers can be greater than the maximum delivery stream of the pressure medium source, where one of the consumers is preferred and receives the full stream required by means of a special device and a second consumer is connected to a multiway valve that is controlled by control pressure, whereby, in order to arrive at a small cost-favorable multiway valve, the multiway valve in the device that causes the preference of the consumer is located between a low-pressure medium source and the control pressure chamber of an additional multiway valve that is hydraulically controlled against spring force and is installed in front of the second consumer, and that the spring-side control pressure chamber of this multiway valve is acted upon by the pressure in the control pressure line and the opposite control pressure chamber of this multiway valve is acted upon with the pressure of the stream flowing to the privileged consumer.

7 Claims, 3 Drawing Figures

DUAL CONSUMER HYDRAULIC MECHANISMS

Figure 1:
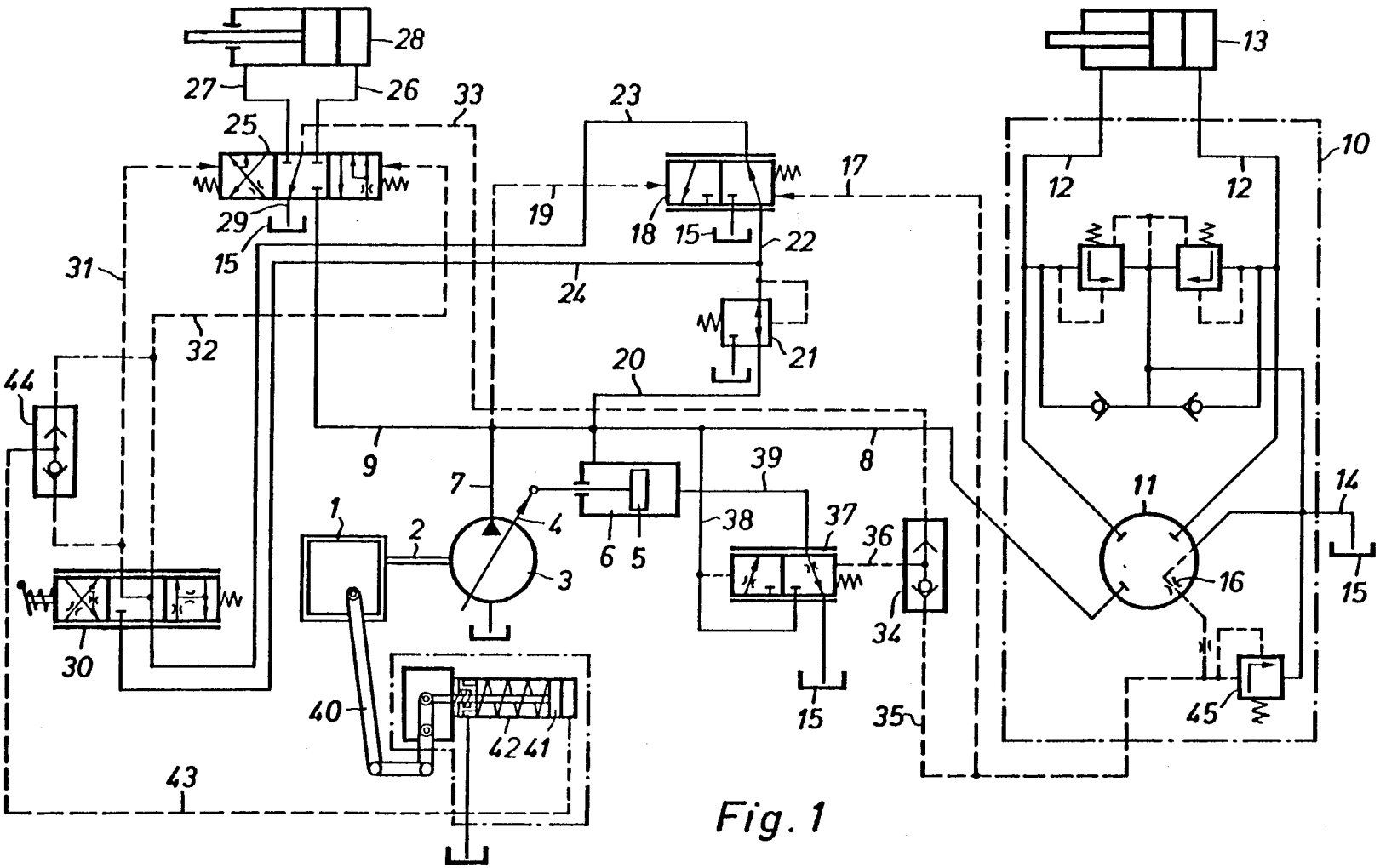

This invention relates to dual consumer hydraulic mechanisms and more particularly to a hydraulic or hydrostatic mechanism or circuit with a pressure medium source and with at least two consumers of hydraulic energy connected to this same pressure medium source, where each of the two consumers is capable of absorbing such a large maximum stream that the sum of these two maximum streams is larger than the maximum delivery stream of the pressure medium source, in which a device with a multiway valve having two control pressure chambers, one of which is spring-loaded, is provided and it causes one of the two consumers to be privileged, i.e., the full stream required by this consumer is always received by it, whereby this consumer emits a pressure signal that is dependent on the stream flowing through this consumer (as is known by the designation "load-sensing regulation") and where the second consumer connected to the pressure medium source is connected to a second multiway valve that is operated by control pressure.

In a vehicle with a pressure medium pump and a hydrostatic auxiliary power steering and with an additional consumer of hydraulic energy, fed by the same pump, e.g., in a fork lift a lifting cylinder or a tilting cylinder for the lift forks, it must be assured that the steering mechanism always receives the full stream required even if this second consumer absorbs a large stream. In order to assure this, a preferential stream regulator is known in a hydrostatic steering mechanism with an open middle setting, in which a stream flows through the steering mechanism even if no steering motion takes place, as a mechanism that makes sure that the required stream flows to the steering mechanism at all times, in which case the stream required by the steering mechanism always flows through this stream regulator and only an excess is diverted through the preferential stream regulator to the second consumer. In steering mechanisms with a closed middle setting, which thus do not absorb any stream if no steering movement takes place, a priority valve is provided as a device that causes the full stream required to be received by the steering mechanism at all times. The working stream of the steering mechanism flows through this priority valve (U.S. Pat. No. 4,023,646). Such valves, through which the full stream going to both consumers flows and which must withstand the maximum pressure in the consumers, are relatively expensive.

The invention proposes a regulating device whose multiway valve is smaller and more cost-favorable.

This goal is achieved according to the invention in that the multiway valve of the device that causes the full stream required to be received by one of the consumers at all times, with this consumer thus being privileged, is located between a low-pressue pressure medium source and the control pressure chamber of a hydraulically controlled additional multiway valve located in front of the second consumer and which is capable of sliding against the force of a spring, and that the spring-side control pressure chamber of the multiway valve of this device that causes the full stream required to be received at all times by one of the consumers is acted upon by the stream-dependent pressure signal and the opposite control pressure chamber of this multiway valve is acted upon with the full pressure of the stream flowing to the consumer that is to receive the full stream, i.e., the preferential consumer. That is, the multiway valve required in order to have the full stream required always flow to one of the consumers does not have the full power stream flow through it, but rather only a small control pressure stream serving for control purposes flows through it and, furthermore, this stream has only a lesser pressure level, so that this multiway valve has to be exposed only to a small stream and thus is considerably less expensive than the priority valves known to date. The multiway valve controlled by the control pressure and located in front of the second consumer is preferably designed so that it has transition positions between the extreme switching positions, in which a throttling action is effected.

In order to be able to control the second consumer at will, an arbitrarily actuatable multiway control valve can be provided in the line leading to it, which is connected in series with the multiway valve of the device that causes one of the consumers to be privileged. This second consumer can, however, also be controlled by one or preferably two control pressure pick-offs, in which case the multiway valve of the device that causes one of the consumers to be privileged is located in the line between the low-pressure pressure medium source and the control pressure pick-off.

There are arrangements in which the second consumer is subjected to a considerably higher pressure than the first one, the privileged consumer. In this case, it can be provided that the stream flowing to the privileged consumer be carried on a separate flow path through the multiway valve of the device that causes this consumer to be the preferred or privileged one. Although in this case a portion of the power stream or the full power stream that flows to the privileged consumer is directed through this valve, it can still be smaller and subjected to a lower maximum pressure than if the stream flowing to the second consumer also had to pass through this valve.

Thus, while a piston manometer controls the total power stream as a function of the pressure differential between the pressure of the delivery stream flowing to the consumer and the pressure signal dependent on the stream flowing to the consumer (generally produced by means of a restrictor) at the privileged consumer, in the device according to the invention the nonprivileged (second-order) consumer is regulated toward a smaller throughflow amount or the power stream flowing to it is throttled upon switching to the privileged consumer. This is also feasible if several secondary, i.e., nonprivileged consumers are present besides the privileged one.

The invention also facilitates achieving an additional advantage. Because a control pressure signal is present in the control pressure line beyond the multiway valve of the device that causes one of the consumers to be preferred only if the total stream delivered by the pressure medium source is not sufficient to supply both consumers with an adequate delivery stream, it is possible to utilize the pressure prevailing in this control pressure line as a signal by which the delivery stream of the pressure medium source is increased. This can be achieved by directing this control pressure into an operating cylinder in which a servo piston is capable of sliding and which is connected with the adjusting element of the primary energy source driving the pressure medium source, so that if this primary energy source is not yet switched to the maximum power or maximum r.p.m. and the delivery stream does not suffice, the pressure signal regulates the adjusting element of the primary energy source to a greater power output or a higher r.p.m. of the primary energy source and thus induces a greater delivery stream of the pressure medium source. An increase in the amount delivered is thus induced upon switching in the privileged consumer, provided the primary energy source had not yet been adjusted to its maximum power output or r.p.m. Thus, upon switching in the privileged consumer below the maximum r.p.m. of the primary energy source, the stream absorbed by the switched-in privileged consumer is compensated, at least partially, by increasing the delivery stream of the pressure medium source.

Figure 2:
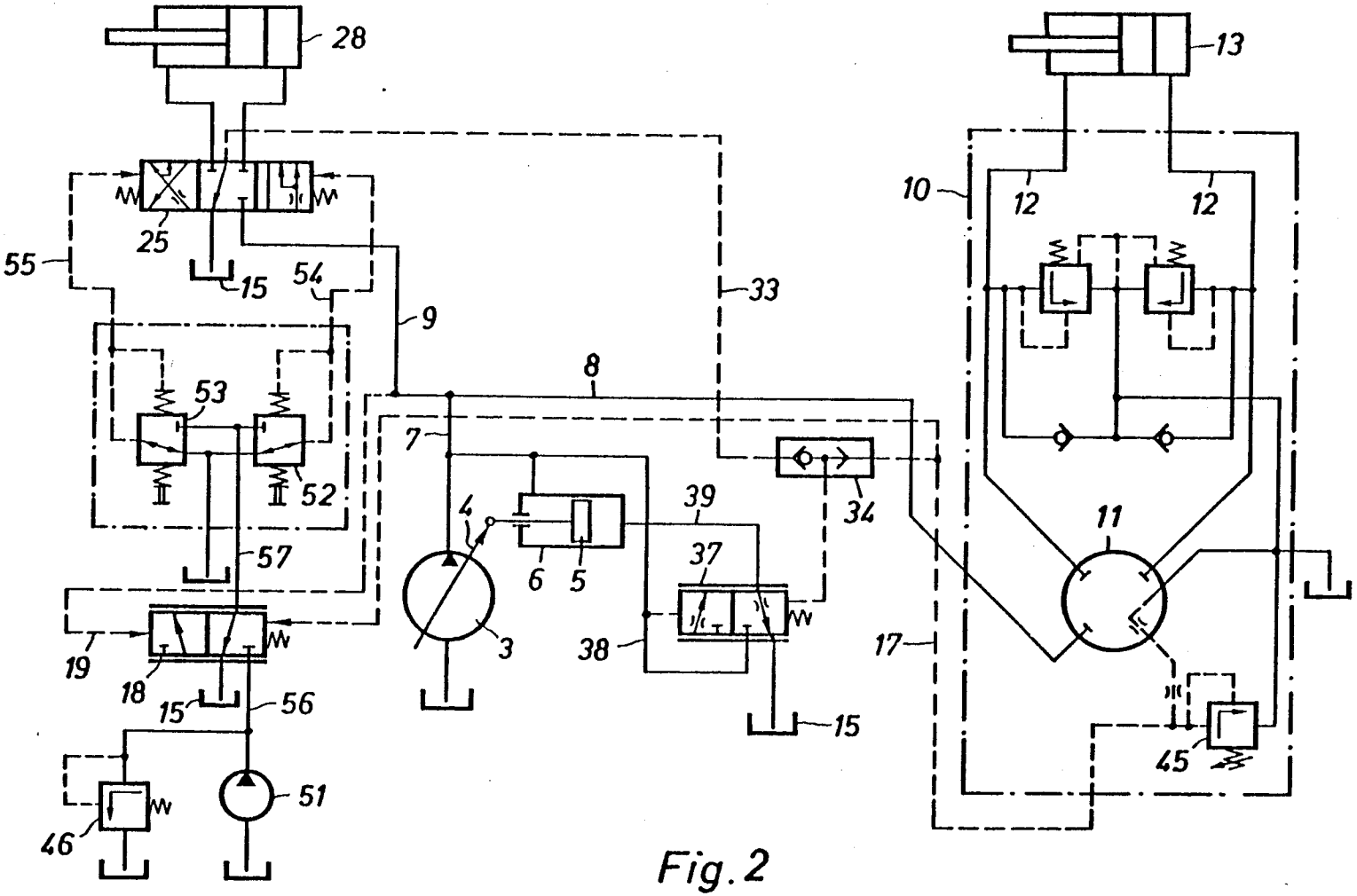
Figure 3:
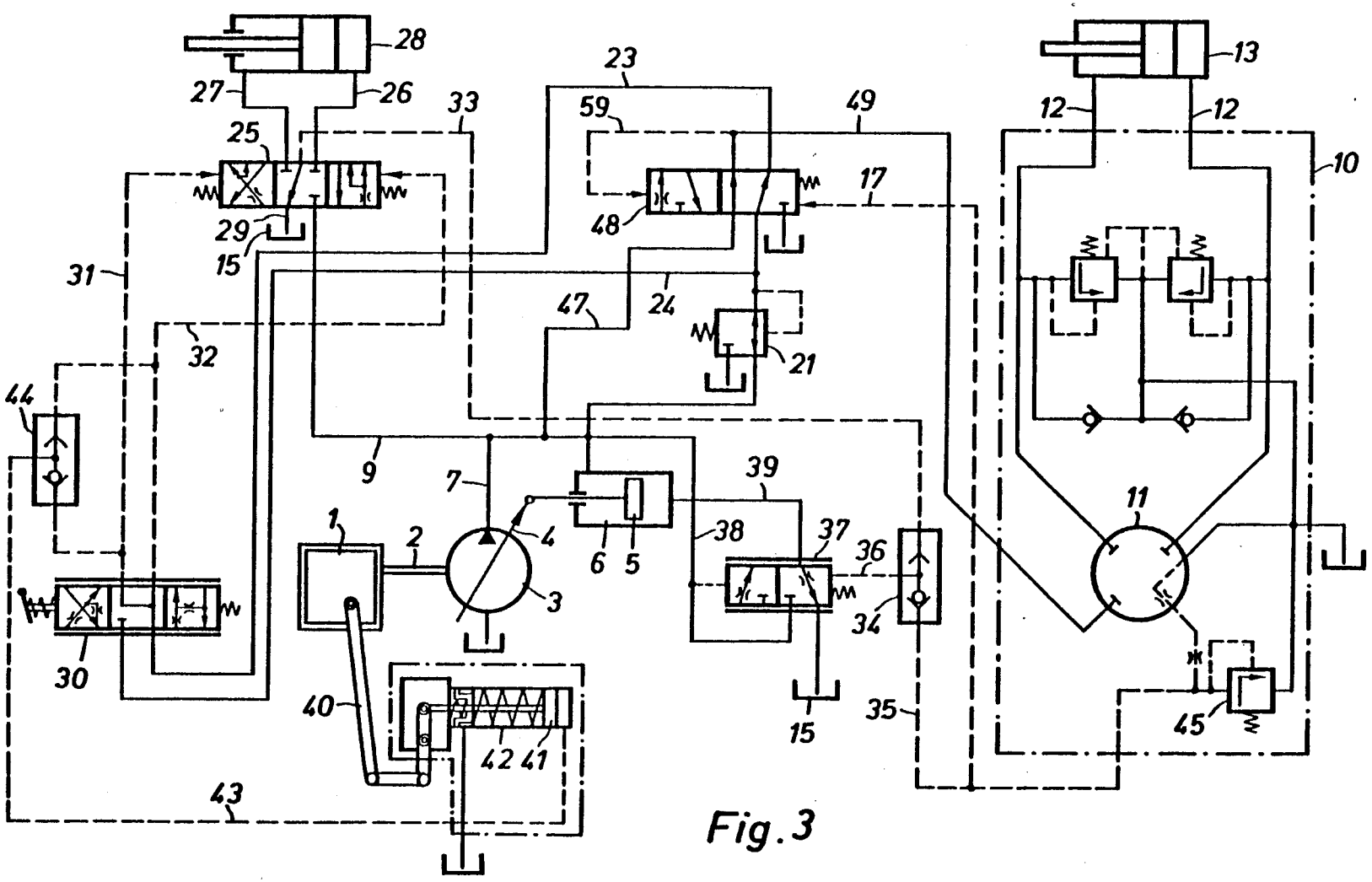

In the foregoing general description of this invention I have set out certain objects, purposes and advantages of this invention. Other objects, purposes and advantages of this invention will be apparent from a consideration of the following description and the accompanying drawings in which:

FIG. 1 shows a diagrammatic arrangement of this invention with a hydrostatic steering mechanism as the preferred consumer and a cylinder as a second-order consumer, which is controlled by means of a multiway valve;

FIG. 2 shows a second embodiment of this invention in diagrammatic arrangement with a steering mechanism as the preferred consumer and a cylinder as the second-order consumer, in which case this cylinder is controlled by control pressure pick-offs; and FIG. 3 shows a third embodiment in diagrammatic arrangement with a steering mechanism as the privileged consumer and a cylinder as the second-order consumer, in which case this cylinder is subjected to a considerably higher working pressure than the steering mechanism.

The internal-combustion engine 1 that serves as the primary energy source drives, via a shaft 2, the adjustment pump 3, which acts as the pressure medium source and whose final control element 4 is connected with a servo piston 5, which is capable of sliding in an operating cylinder 6. The pump 3 delivers into a feed line that branches into two branch feed lines 8 and 9, where the branch line 8 leads to the steering mechanism 10, which is the privileged consumer and in which a steering valve 11 is provided, from which two lines 12 lead to a steering cylinder 13. The departing pressure medium flows over a line 14 to a pressure-less reservoir 15. By means of a restrictor 16, a pressure signal dependent on the stream flowing through the steering mechanism 10 is produced, which in the pressure-signal line 17 leads to the spring-side control pressure chamber of a control pressure-controlled two-position/two-connection multiway valve 18. The control pressure chamber of the multiway valve 18 opposite the spring is acted upon by the pressure flowing from the pump 3 to the steering mechanism 10 through the line 19, which is connected with the line 8. A line 20 is connected to the line 8 and it leads to a pressure-reducing valve 21, which acts here as a low-pressure pressure medium source and from which the low-pressure line 22 departs; this line 22 is connected to the first connection of the multiway valve 18. The control pressure line 23 is connected to the second connection of the multiway valve 18. The control pressure line 24 is connected directly to the line 22. The two control pressure lines 23 and 24 serve to load the two control pressure chambers of the additional multiway valve 25 with control pressure. This additional multiway valve 25 serves to direct pressure medium through one of the two lines 26 and 27 to the cylinder 28 provided as the second consumer or to draw off pressure medium on the second side through the line 29 to the reservoir 15.

Another arbitrarily actuatable multiway valve 30 is installed between the two control pressure lines 23 and 24 on the one hand and the additional multiway valve 25 on the other. From it, the two control pressure lines 31 and 32 lead to the two control pressure chambers of the additional multiway valve 25. The control pressure line 23 can be selectively connected with the control pressure line 32 and the control pressure line 24 with the control pressure line 31 or, inversely, the control pressure line 23 with the control pressure line 31 and the control pressure line 24 with the control pressure line 32 through the additional arbitrarily actuatable multiway valve 30, so that the position of the additional multiway valve 25 and thus the direction and speed of movement of the piston in the cylinder 28 can be controlled by arbitary actuation of the additional multiway valve 30.

A control pressure line 33 departs from a middle connection of the additional multiway valve 25, at which the pressure loading the cylinder 28 prevails, and it leads to an inlet of a pressure-dependent automatic reversing valve 34, whose other inlet is connected through the line 35 to the pressure signal line 17, in which case the valve 34 connects the one of the two lines 33 and 35 carrying the higher pressure with the line 36, which is located on the spring-side control pressure chamber of the regulating multiway valve 37, whose opposite pressure chamber is connected through the line 38 to the lines 7, 8, and 9, and which in a familiar manner controls the pressure-loading of the operating cylinder 6 through the line 39 such that the final control element 4 of the pump 3 is always adjusted so that the pump 3 delivers the stream required in common by the consumers 10 and 28.

The mode of operation is as follows: during normal operation the pressure in the line 19 is so much higher than the pressure in line 17 that the force exerted by this pressure shifts the piston in the multiway valve 18 against the force of the spring into the position in which the valve 18 shuts off the lines 22 and connects the line 23 with the reservoir 15. The additional multiway valve 25 can be arbitrarily controlled in this state through the additional multiway valve 30 so that the cylinder 28 is acted upon as it is arbitrarily controlled.

However, if the privileged or priority consumer 10 receives an excessively small delivery stream through the line 8, the pressure rises in line 17 relative to the pressure in the line 19, with the result that the force of the spring shifts the valve 18 into the direction in which the valve 18 connects the control pressure line 23 with the low-pressure line 22 so that the pressure in the control pressure line 23 increases, at first sharply throttled, but then increasingly, with the result that the second control pressure chamber at the additional multiway valve 25 is acted upon independently of the position of the additional multiway valve 30 and it is increasingly shifted under the action of the force of the springs toward its neutral position, so that the stream flowing to the consumer 28 is increasingly throttled, i.e., so that a continuously decreasing stream flows to the consumer 28, and thus a sufficiently large stream flows through the line 8 to the preferred consumer 10.

The final control element 40 of the internal combustion engine 1 is connected with a servo piston 41, which is capable of sliding in an operating cylinder 42 against the force of a spring. The operating cylinder 42 is connected through a line 43 with a reversing valve 44, which is incorporated between the two lines 31 and 32. This additional device has the effect that, if a signal is given through the displacement of the multiway valve 18 that the stream flowing to the consumer, i.e., the steering mechanism 10, is insufficient and thus the stream flowing to the consumer 28 must be throttled, a pressure signal is simultaneously given to the operating cylinder 42 so that the internal combustion engine 1 is adjusted to a higher r.p.m. or a higher power output. Because the stream that flows from the line 24 to the controlled control pressure chamber of the additional multiway valve 25 is throttled in the multiway valve 30, the stream flowing from the line 23 to the opposite control pressure chamber of the additional valve 25 flows through unthrottled and the reversing valve 44 switches the higher pressure from the line 31 or 32 to the line leading to the operating cylinder 42.

The embodiment according to FIG. 2 differs from that according to FIG. 1 in that the steering mechanism 10 is subjected to a considerably lesser maximum pressure than the cylinder 28. For example, the pressure-limiting valve or relief valve jet 45 in the steering mechanism 10 can be subjected to 140 bar, while the steering cylinder 28 is subjected to 190 bar. In the arrangement according to FIG. 2 a multiway valve 48 is provided instead of the multiway valve 18 present in the arrangement according to FIG. 1. This valve 48 differs from the multiway valve 18 in that it has an additional flow path, with which the line 47 connected to the line 7 can be connected with the line 49, which leads to the steering mechanism 10 and to which the control pressure line 59 is connected. Depending on the position of the valve 48, an unthrottled or more or less throttled connection is produced between the lines 47 and 49. Otherwise, the mode of operation is the same as in the device according to FIG. 1.

The device according to FIG. 3 differs from the device in FIG. 1 only in that in this case the consumer 28 is not controlled by the additional multiway valve 30, but by two control pressure pick-offs 52 and 53, through which the two control pressure chambers of the additional valve 25 are acted upon through the lines 54 and 55. The two control pressure pick-offs 52 and 53 are loaded with pressure by the auxiliary pump 51 provided as a low-pressure pressure medium source, whereby the loading with pressure takes place through the multiway valve 18. During normal operation, the multiway valve 18 is forced by the pressure prevailing in the line 19, which is so much greater than the pressure in line 17 that the force of the spring is overcome, into the position in which the delivery line 56 of the pump 51 is connected with the line 57, to which the two control pressure pick-offs 52 and 53, which are designed as relief valve jets, are connected. However, if the pressure in the line 17 increases as a result of an excessively small stream flowing to the steering mechanism 10, the pressure prevailing in line 17 displaces the multiway valve 18 so that it increasingly connects the line 57 with the pressure-less reservoir 15, so that a low pressure is still available to the control pressure pick-offs 52 and 53. Thus, due to the low pressure in front of the control pressure pick-offs 52 and 53, the pressure in the one of the two lines 54 and 55 that is controlled also drops and thus the additional valve 25 is again shifted into the position in which the stream flowing to the consumer 28 through the line 9 is throttled.

In the foregoing specification, I have set out certain preferred practices and embodiments of this invention, however, it will be understood that this invention may be otherwise embodied within the scope of the following claims.

I claim:

1. In a dual consumer hydraulic mechanism having a source of fluid under pressure, a drive means for said source of fluid, and at least two consumers of hydraulic energy including one primary consumer connected to an receiving fluid under pressure from said source of fluid and in which the maximum fluid consumed by said consumers is greater than the maximum fluid delivery from said source of fluid, the improvement comprising a first multiway valve having two control pressure chambers, one acted upon by fluid pressure from said source to said primary consumer, resilient means acting on said multiway valve normally to reduce the volume of said other chamber, the other of said chambers being connected to pressure signal means at said primary consumer which act in conjunction with said resilient means, a second multiway valve having first and second spring loaded control chambers and a feed chamber connected to the other of said at least two consumers, connection means from said feed chamber to said fluid sorce, selecting means between said first and second multiway valves selectively connecting one of said first and second control chamber of said second multiway valve to a first connection of said first multiway valve, a low pressure source of fluid connected to a second connection on said first multiway valve and through said valve to the first connection, said low pressure source being connected also to the other of said first and second control chambers of said second multiway valve by said selecting means whereby said primary consumer receives the full stream required for its operation as a result of the spring and pressure signal acting on the first multiway valve against the fluid pressure flowing to said primary consumer and at the same time the second multiway valve is acted upon by fluid from the low pressure source through the selecting means simultaneously to reduce flow to the other of said at least two consumers from said fluid source.

2. A mechanism according to claim 1, wherein the selecting means is an arbitrarily actuable third multiway control valve located in the control pressure line leading to the control pressure chamber of the second multiway valve.

3. A mechanism according to claim 1, wherein the primary consumer to which the full stream required is to continuously flow is designed for a lower pressure than the second consumer, and wherein the stream flowing to the primary consumer to which the required stream is to continuously flow is sent on a separate flow path through the first multiway valve of the device that causes the required stream to flow continuously to one of the consumers.

4. A mechanism according to claim 1, wherein the second consumer is connected to a third multiway valve, a control pressure chamber in said third valve opposite a spring connected to an arbitrarily actuatable control pressure pick-off, a connection from said arbitrarily actuatable pick-off to the low-pressure pressure medium source, and wherein the first multiway valve is located between the low-pressure pressure medium source and the control pressure pick-off.

5. A mechanism according to one of the preceeding claims, wherein the primary consumer to which the required stream is to continuously flow is a hydrostatic auxiliary power steering mechanism of a vehicle.

6. A mechanism according to claim 5, wherein the vehicle is an industrial truck and the other consumer is at least a cylinder in active connection with a lifting mechanism.

7. A mechanism according to any one of the preceeding claims 1 through 4, wherein a branch line forks off of the control pressure connection line from the other chamber of said first multiway valve and this said branch line leads to an operating cylinder, a servo piston in said cylinder, an adjusting element on the drive means that drives the fluid pressure source connected to said servo piston for regulating said drive means.

* * * * *